US006726384B2

(12) United States Patent
Allen et al.

(10) Patent No.: US 6,726,384 B2
(45) Date of Patent: Apr. 27, 2004

(54) PAPER CONTROLLED CLUTCH FOR A PAPER EXIT SYSTEM IN A PRINTER

(75) Inventors: Eugene David Allen, Okeana, OH (US); Brandon Sung-Hwan Song, Lexington, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/995,895

(22) Filed: Nov. 28, 2001

(65) Prior Publication Data

US 2003/0099498 A1 May 29, 2003

(51) Int. Cl.[7] ..... B65H 3/24

(52) U.S. Cl. ..... 400/707.1; 400/708; 400/622; 400/645; 400/602; 271/121

(58) Field of Search ..... 400/707.1, 708, 400/602, 703, 700, 634, 645, 622, 623; 271/121, 122, 123, 124

(56) References Cited

U.S. PATENT DOCUMENTS

| | | | | | |
|---|---|---|---|---|---|
| 4,641,954 | A | * | 2/1987 | Miyata et al. | 399/87 |
| 4,744,296 | A | | 5/1988 | Edwards et al. | 101/269 |
| 4,834,568 | A | | 5/1989 | Kagami et al. | 400/707.1 |
| 4,892,299 | A | * | 1/1990 | Hayama | 271/110 |
| 5,226,743 | A | | 7/1993 | Jackson et al. | 400/625 |
| 5,507,478 | A | | 4/1996 | Nottingham et al. | 271/10.02 |
| 5,530,535 | A | * | 6/1996 | Matsuoka | 399/313 |
| 5,630,579 | A | | 5/1997 | Minami et al. | 271/3.15 |
| 5,775,685 | A | | 7/1998 | Yamaoka et al. | 271/10.13 |
| 5,954,326 | A | | 9/1999 | Gaarder et al. | 271/9.02 |
| 5,961,224 | A | | 10/1999 | Baitz et al. | 400/56 |
| 6,038,424 | A | | 3/2000 | Nakagawa | 399/367 |
| 6,155,680 | A | * | 12/2000 | Belon et al. | 347/104 |
| 6,382,621 | B1 | * | 5/2002 | Inoue et al. | 271/120 |
| 6,478,295 | B2 | * | 11/2002 | Hwang et al. | 271/115 |

FOREIGN PATENT DOCUMENTS

| | | | |
|---|---|---|---|
| JP | 0440921 | 8/1991 | B41J/13/036 |

* cited by examiner

*Primary Examiner*—Ren Yan
*Assistant Examiner*—Dave A. Ghatt
(74) *Attorney, Agent, or Firm*—Taylor & Aust, P.C.

(57) ABSTRACT

A print medium exit system in a printer includes a kicker device ejecting a sheet of print medium out of the printer. A clutch mechanism prevents actuation of the kicker device when the clutch mechanism is engaged by the sheet of print medium.

8 Claims, 3 Drawing Sheets

PAPER CONTROLLED CLUTCH FOR A PAPER EXIT SYSTEM IN A PRINTER

BACKGROUND OF THE INVENTION

1. Field of the Invention

The present invention relates to printers, and, more particularly, to a print medium exit system for a printer.

2. Description of the Related Art

Most ink jet printers have a star-wheel exit system in which the star-wheels are directly linked to a feed roll shaft. The feed roll shaft simply keeps turning forward to drive print media out of the printer after printing. A problem is that the star wheels touch the printed surface of the paper and sometimes cause the ink to smear or cause small "star wheel" tracks on the printed image.

It is also known to control the exiting media in an exit system by requiring motion of a printhead carrier or some other power source. For instance, in a kicker exit system, the kickers emerge from behind a final nip and push/kick the print media out of the printer. The kicker exit system has the advantage that the printed surface of the paper is never touched, so there is no smearing of the ink. Unlike the star-wheel exit system that runs all the time because it is always linked to the feed roll shaft, the kicker exit system requires activation because it only needs to run after a print job. The printhead can be used to activate the kicker system. However, using the printhead has some disadvantages, such as decreasing throughput. This is especially true if the printhead carrier is away from the kicker mechanism because it takes time to bring the printhead over to a desired location for activation. Also, problems may result if the printhead has to go through a maintenance cycle during an exit operation.

What is needed in the art is a paper exit system that does not touch the printed surface of the paper and that is not activated by a printhead carrier.

SUMMARY OF THE INVENTION

The present invention provides a kicker media exit system activated by a mechanical clutch controlled by the presence of media passing through the nip.

The invention comprises, in one form thereof, a print medium exit system in a printer. A kicker device ejects a sheet of print medium out of the printer. A clutch mechanism prevents actuation of the kicker device when the clutch mechanism is engaged by the sheet of print medium.

The invention comprises, in another form thereof, a method of ejecting a sheet of print medium from a printer. It is sensed when the sheet of print medium is at a predetermined location along a paper path in the printer. A print medium exit system is activated dependent upon the sensing step.

An advantage of the present invention is that the exit system does not touch the printed surface of the paper, so no smearing of the ink occurs.

Another advantage is that the kicker exit system is not activated by a printhead carrier, so throughput is increased and positioning issues are eliminated.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
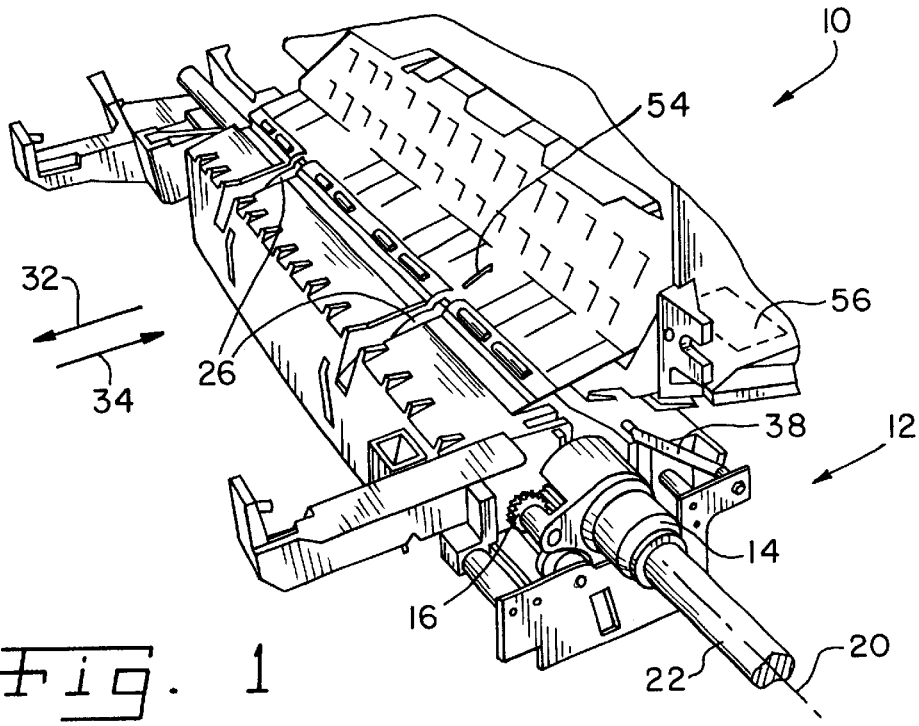
FIG. 1 is a fragmentary, perspective view of one embodiment of a printer and an associated print media exit system of the present invention.
Figure 2:
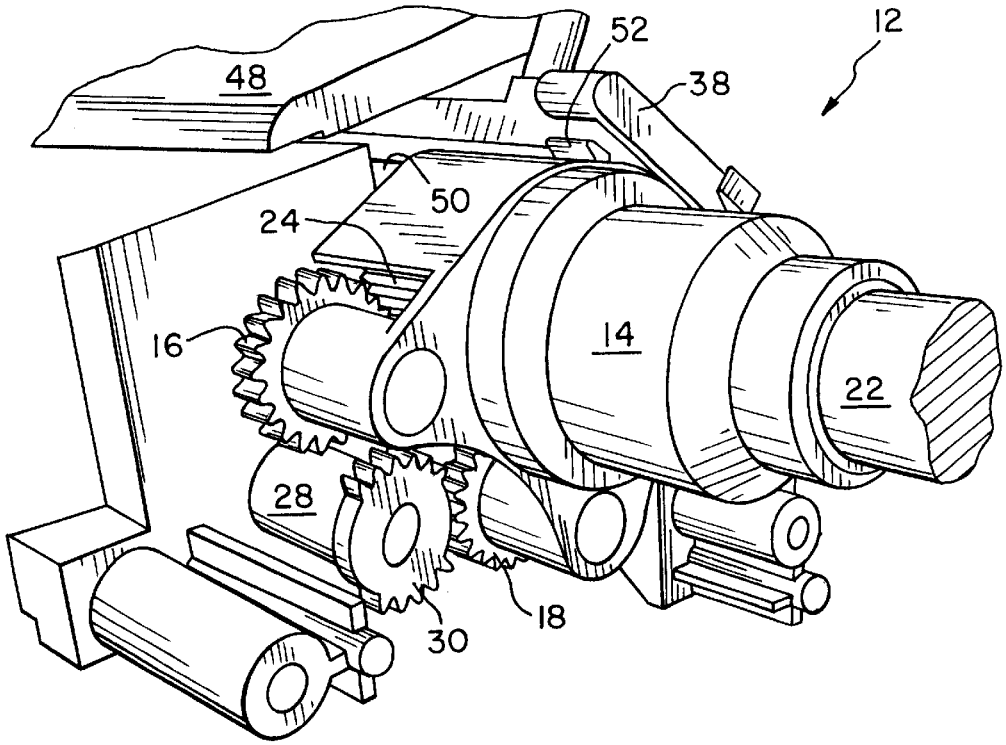
FIG. 2 is an enlarged perspective view of the exit system of FIG. 1.

Referring now to the drawings and particularly to FIG. 1, there is shown one embodiment of a printer 10 of the present invention including a print media exit system 12. Exit system 12 includes a toggle arm 14 having two peripherally attached gears 16, 18 (FIG. 2). Toggle arm 14 pivots about an axis 20 of a feed roll shaft 22 with a feed roll gear 24 in the center. Kickers 26 are linked to a pivot shaft 28.

At the beginning of a kick cycle, feed roll shaft 22 and toggle arm 14 rotate counterclockwise in the perspective of FIG. 1 to thereby move gear 16 into engagement with a pivot shaft gear 30. Feed roll gear 24 then rotates counterclockwise, thereby causing a clockwise rotation of gear 16, which, in turn, causes a counterclockwise rotation of pivot shaft gear 30. The counterclockwise rotation of pivot shaft gear 30 actuates or advances kickers 26 in direction 32 to push the print medium out of printer 10. After kickers 26 clear the print medium, feed roll shaft 22 reverses, i.e., feed roll gear 24 rotates clockwise, which causes toggle arm 14 to toggle backward and gear 18 to engage pivot shaft gear 30. With feed roll gear 24 now rotating clockwise, gear 18 rotates counterclockwise, which, in turn, causes a clockwise rotation of pivot shaft gear 30. The clockwise rotation of pivot shaft gear 30 causes kickers 26 to move in direction 34, back to their original positions.

Figure 3:
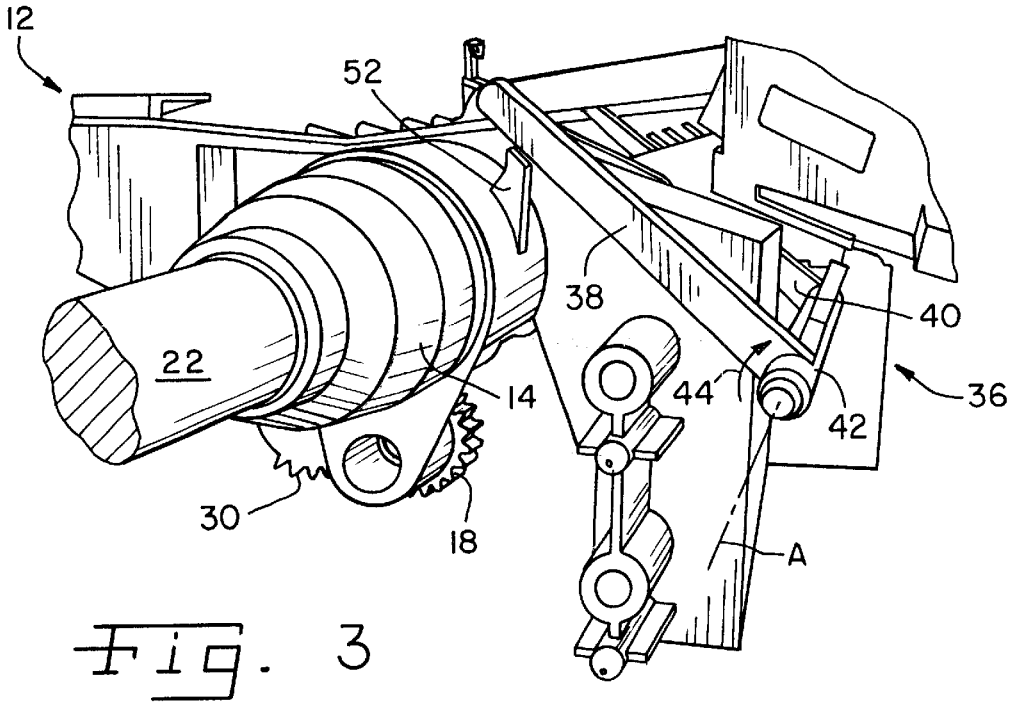
FIG. 3 is another perspective view of the exit system of FIG. 1.
Figure 4:
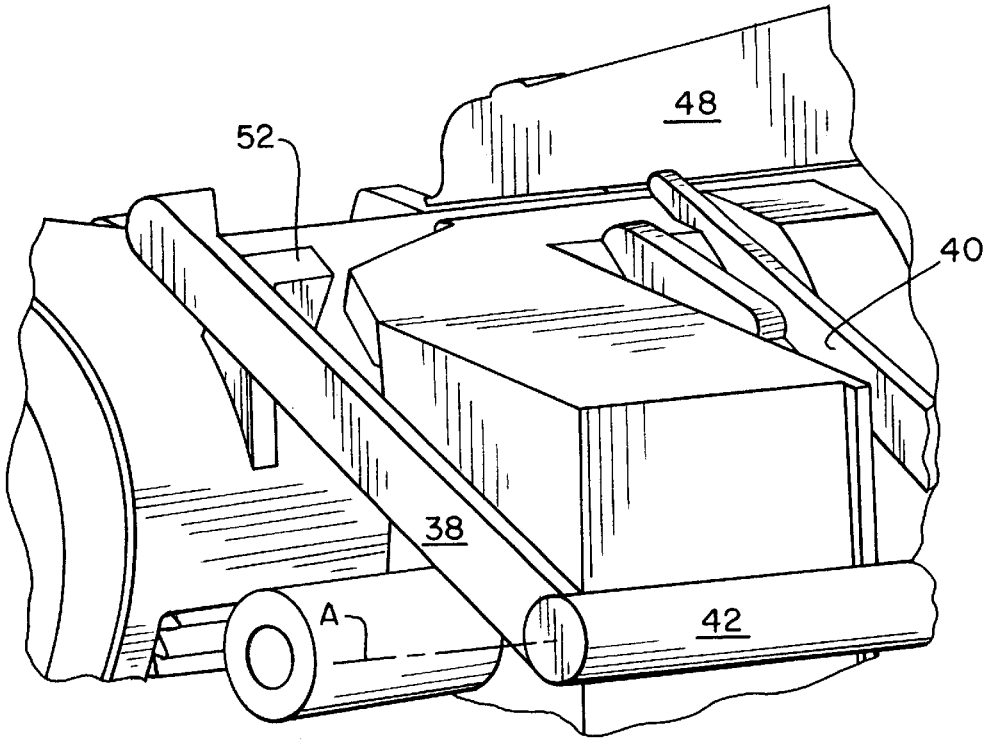
FIG. 4 is yet another perspective view of the exit system of FIG. 1.
Figure 5:
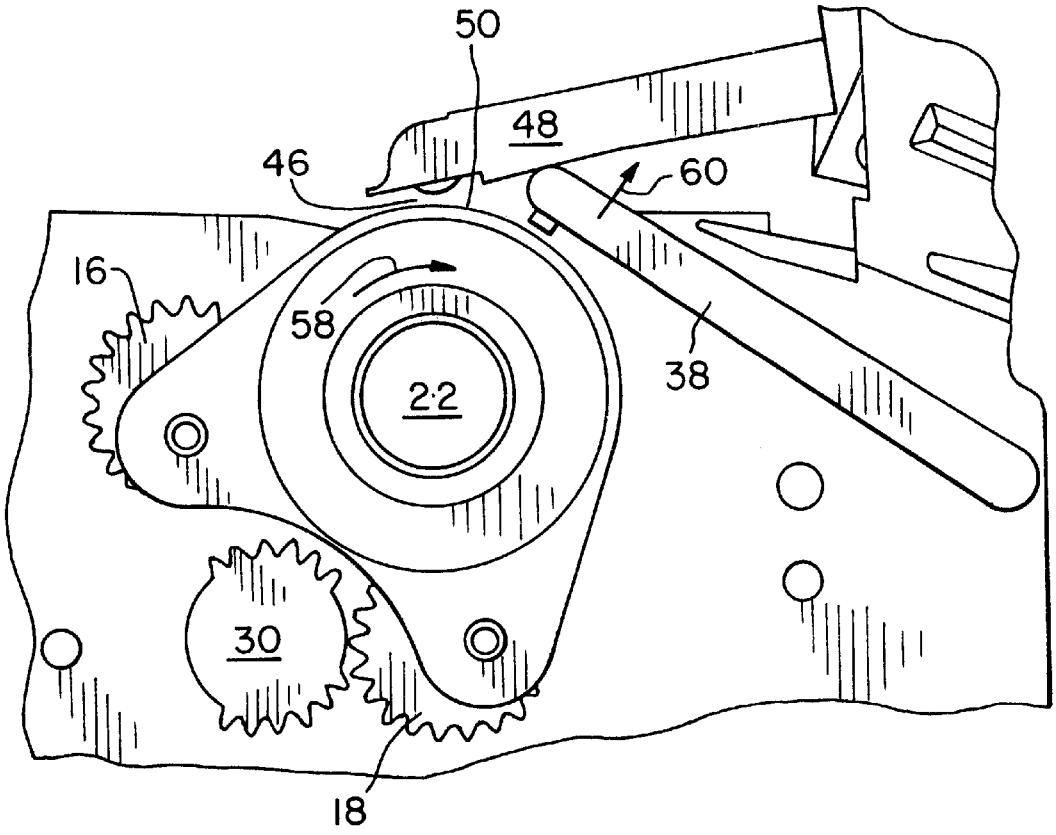
FIG. 5 is a side view of the exit system of FIG. 1.

A clutch flag mechanism 36 (FIGS. 3 and 4) is used as an activation mechanism and includes a clutch flag 38 and a paper-activated flag 40 joined by a connecting bar 42. Clutch flag 38 is disposed above toggle arm 14, and paper-activated-flag 40 is disposed in the paper path. Clutch flag mechanism 36 is spring-loaded in the direction indicated by arrow 44. Clutch flag mechanism 36 is disposed under an automatic sheet feeder and behind a nip 46 (FIG. 5) between a pressure roll arm 48 and a feed roll 50. Nip 46 is the final nip in the paper path of printer 10. Clutch flag mechanism 36 pivots about line A and can rotate only about 9 degrees. Without an activation mechanism such as clutch flag mechanism 36, kickers 26 would operate whenever feed roll shaft 22 turns forward (counterclockwise) because the exit transmission is a simple toggle clutch.

When the automatic sheet feeder picks a sheet and brings the sheet to nip 46, feed roll shaft 22 reverses to de-skew. As the picked sheet moves into nip 46, its forward edge engages paper-activated flag 40 at a predetermined point along the paper path. As the sheet of paper pushes paper-activated flag 40 down, the whole clutch flag mechanism 36 rotates in the counterclockwise direction. Clutch flag 38 is now disposed in the path of a hook 52 on toggle arm 14. As feed roll shaft 22 changes direction and turns forward (counterclockwise) to bring the sheet into the print zone, toggle arm 14 toggles gear 16 forward toward pivot shaft gear 30. However, hook 52 on toggle arm 14 mates with clutch flag 38 and prevents toggle arm 14 from rotating further to engage gear 16 with pivot shaft gear 30. Because of the engagement angle between hook 52 and clutch flag 38, they cannot come apart unless feed roll shaft 22 reverses (rotates clockwise). Now, with hook 52 mated with clutch flag 38, printer 10 is able to print without exit system 12 being activated. Clutch flag 38 prevents gear 16 from engaging and rotating pivot shaft gear 30 when paper-activated flag 40 is engaged by the sheet of paper.

When the print job is finished and the trailing edge of the sheet of paper has advanced past paper-activated flag 40, a spring-loaded arm sensor 54 detects the presence of the trailing edge of the sheet at another predetermined point along the paper path. More particularly, sensor 54 detects when the trailing edge of the sheet is about to enter nip 46. This point where sensor 54 detects the trailing edge of the sheet of paper can be approximately adjacent to, or slightly downstream from, the point along the paper path where paper-activated flag 40 is engaged by the sheet of paper. Sensor 54 sends a signal to microcontroller 56 indicating that the trailing edge of the sheet is about to enter nip 46. When the trailing edge has advanced past nip 46, printer 10 is ready to eject the printed medium. In response to the signal from sensor 54, microcontroller 56 activates exit system 12. That is, microcontroller 56 causes feed roll shaft 22 to reverse, i.e., turn clockwise as indicated by arrow 58. Spring-loaded clutch flag mechanism 36 is then free to rotate upward, as indicated by arrow 60, because there is no longer any paper pushing down on paper-activated flag 40. The angular rotation of feed roll shaft 22 in direction 58 is just enough to release clutch flag 38 from hook 52, e.g., 90 degrees or less. Then, feed roll 50 turns forward (counterclockwise) so that gear 16 engages and rotates pivot shaft gear 30 such that kickers 26 are activated.

After kickers 26 kick the paper out of printer 10, the exit cycle is finished by feed roll shaft 22 rotating in the reverse direction (clockwise) to bring kickers 26 back to their original position. This exit cycle repeats for the next sheet.

Clutch flag mechanism 36 is print media controlled in the sense that clutch flag 38 locks toggle arm 14 in place only if there is a sheet of paper behind nip 46. All that is required to activate exit system 12 is a slight reverse motion of feed roll shaft 22 and toggle arm 14, not an external input such as a movement of a printhead.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A print medium exit system in a printer, said system comprising:

a kicker device configured to eject a sheet of print medium out of the printer;

a clutch mechanism configured to prevent actuation of said kicker device when said clutch mechanism is engaged by the sheet of print medium, wherein said clutch mechanism includes a print medium-activated component configured to be engaged by the sheet of print medium; and a clutch device attached to said print medium-activated component and configured to prevent actuation of said kicker device;

an actuator configured to actuate said kicker device;

a feed roll shaft;

at least one gear attached to said feed roll shaft and configured to rotate said actuator; and a hook attached to said feed roll shaft, wherein said clutch device is configured to prevent said at least one gear from engaging said actuator when said print medium-activated component is engaged by the sheet of print medium, and said clutch device being configured to mate with said hook when said print medium-activated component is engaged by the sheet of print medium.

2. A method of ejecting a sheet of print medium from a printer, comprising the steps of:

sensing when the sheet of print medium has been advanced by a feed roller rotating in a forward direction to a predetermined location along a paper path in the printer;

activating a print medium exit system by driving said print medium exit system based on said rotation of said feed roller in said forward direction in said sensing step to eject the sheet of print medium from said printer, wherein said print medium exit system includes a kicker device and a clutch mechanism, said activating step including using said kicker device to eject the sheet of print medium out of the printer; and using said clutch mechanism to prevent actuation of said kicker device when said clutch mechanism is engaged by the sheet of print medium.

3. The method of claim 2, wherein said clutch mechanism includes a print medium-activated component and a clutch device attached to said print medium-activated component, said using step including:

engaging said print medium-activated component; and preventing actuation of said kicker device by using said clutch device, said preventing step being dependent upon said engaging step.

4. The method of claim 2, wherein said activating step includes:

rotating a feed roll shaft in a reverse direction to thereby disengage said clutch mechanism; and rotating said feed roll shaft in a forward direction to thereby cause actuation of said kicker device.

5. A printer, comprising a print medium exit system configured to be activated by a presence of a sheet of print medium at a predetermined point in a paper path, wherein said print medium exit system is configured to be mechanically locked by action of the sheet of print medium upon said print medium exit system, wherein said print medium exit system includes:

a kicker device configured to eject the sheet of print medium out of the printer; and a clutch mechanism configured to prevent actuation of said kicker device when said clutch mechanism is engaged by the sheet of print medium.

6. The system of claim 5, wherein said clutch mechanism includes:

a print medium-activated component configured to be engaged by the sheet of print medium; and a clutch device attached to said print medium-activated component and configured to prevent actuation of said kicker device.

7. A print medium exit system in a printer, said system comprising:

a kicker device configured to eject a sheet of print medium out of the printer;

a clutch mechanism configured to prevent actuation of said kicker device when said clutch mechanism is engaged by the sheet of print medium, wherein said clutch mechanism includes a print medium-activated component configured to be engaged by the sheet of print medium; and a clutch device attached to said print medium-activated component and configured to prevent actuation of said kicker device;

an actuator configured to actuate said kicker device;

a feed roll shaft; and at least one gear attached to said feed roll shaft and configured to rotate said actuator, wherein said at least one gear comprises a first gear and a second gear, wherein, of the first and second gears, only said first gear is configured to rotate said actuator such that said kicker device is actuated, and only said second gear is configured to rotate said actuator such that said kicker device is returned to an original position.

8. The system of claim 7, wherein said first gear is configured to rotate said actuator when said feed roll shaft rotates in a first direction, said second gear being configured to rotate said actuator when said feed roll shaft rotates in a second direction opposite to said first direction.

* * * * *